United States Patent [19]

Deering, Jr.

[11] 4,238,269

[45] Dec. 9, 1980

[54] TAPE APPLYING DEVICE

[75] Inventor: Hartland W. Deering, Jr., Inver Grove Heights, Minn.

[73] Assignee: Minnesota Mining and Manufacturing Company, St. Paul, Minn.

[21] Appl. No.: 960,165

[22] Filed: Nov. 13, 1978

[51] Int. Cl.[2] ..... B31F 1/00; B32B 31/00

[52] U.S. Cl. ..... 156/465; 156/468; 156/522

[58] Field of Search ..... 156/522, 355, 465, 200, 156/201, 468, 475, 477, 478, 482

[56] References Cited

U.S. PATENT DOCUMENTS

| | | | |
|---|---|---|---|
| 2,052,903 | 9/1936 | Stagmeier | 156/468 |
| 2,684,240 | 7/1954 | Lindsey | 156/465 |

*Primary Examiner*—Douglas J. Drummond
*Attorney, Agent, or Firm*—Cruzan Alexander; Donald M. Sell; William L. Huebsch

[57] ABSTRACT

A device for applying tape to a box driven past the device in which an end of the tape to be applied is initially held adjacent an application member in the path for the box with its adhesive coating facing the box. After the box contacts the tape, the application member is moved by movement of the box to a second position at the side of the object along an essentially linear path disposed so that a component of movement of the application member is in the direction of the movement of the box. Also means are provided to form a central ridge in the end portion of the tape adjacent the contact member to keep it in position prior to contact by a box.

7 Claims, 10 Drawing Figures

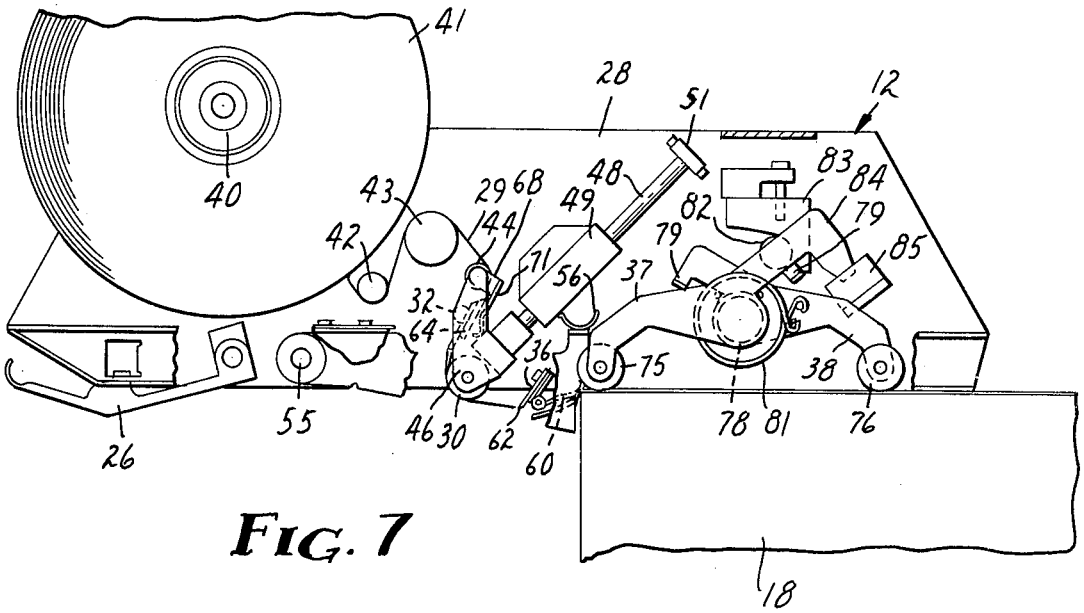
FIG. 7
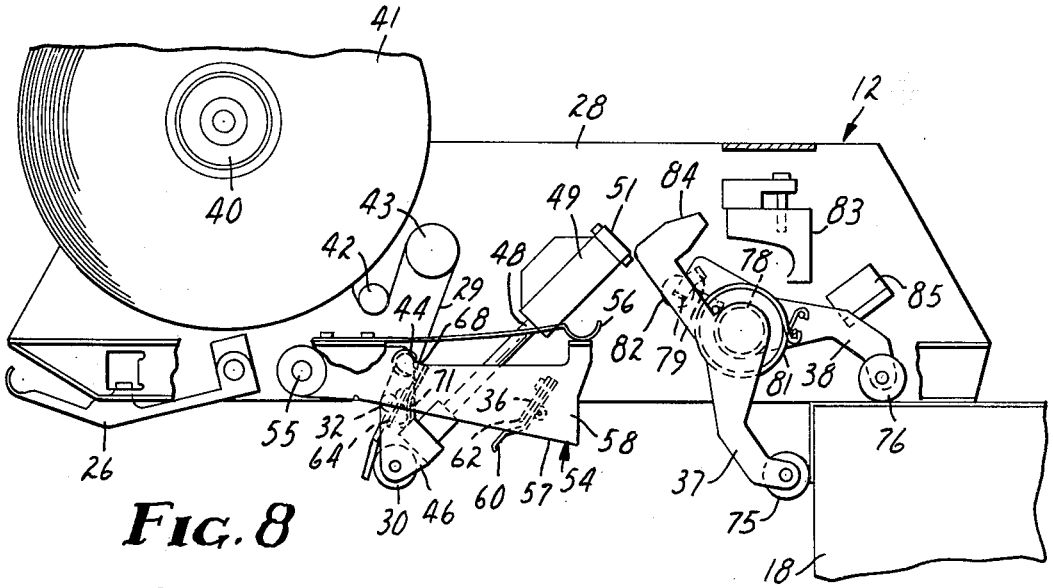
FIG. 8
FIG. 9
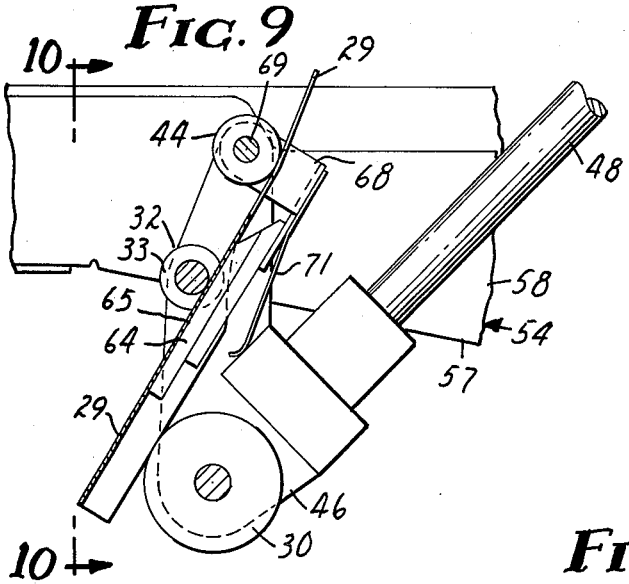
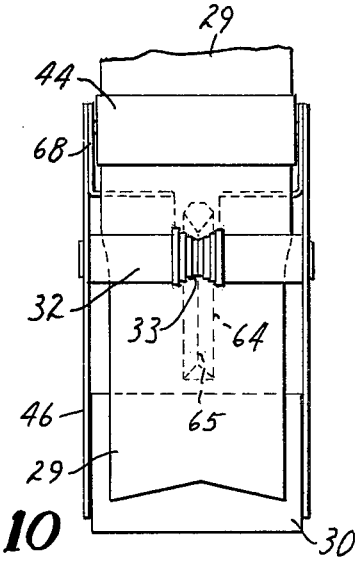
FIG. 10

TAPE APPLYING DEVICE

BACKGROUND OF THE INVENTION

This invention relates to devices for applying lengths of pressure sensitive adhesive coated tape to rectangular objects such as a box driven along a predetermined path past the device.

The art is replete with such devices, U.S. Pat. Nos. 3,915,786 and 3,954,550 being illustrative examples. Such devices are commonly used to seal rectangular boxes filled with merchandise driven past the device by a conveyor. Typically such devices include an application member such as a roller for supporting an end of the tape adhesive side out in a contact position at which the tape end will be contacted by a box. Upon such contact the tape end adheres to the box. Further movement of the box then pulls the tape from the device between the box and the application member which presses the tape against the contour of the box. Subsequently the applied length of tape is severed from the supply length of tape and means on the device engages the tape adjacent the newly severed end and moves it with the application member back to its contact position for contact by the next box on the conveyor.

Typically the application member is mounted at one end of an arm which has its other end pivotably mounted at one edge of the path for the boxes so that after the leading surface of the box contacts the tape on the member, the member will revolve about the pivot point of the arm to follow the contour of the box and press the tape sequentially against the leading surface of the box, around a leading edge of the box adjacent the pivot point for the arm defined by adjacent edge portions of two butted cover flaps of the box, and then over adjacent portions of the cover flaps longitudinally of the box to seal the cover flaps together. Because of the decrease in angle between the leading surface of the box and a line between the pivot point for the arm and the application member as the box moves along the path, however, the force applied by the leading surface of the box to move the application member across its leading surface will increase significantly as the application member approaches the edge of the box and can become sufficiently large just before the edge of the box passes the application member to push in the leading wall of the box under its two cover flaps, particularly for lightly constructed boxes. This can damage merchandise in the box, and even if it does not, it will produce a taped box in which the tape bridges several centimeters between the cover flaps of the box and a portion of the front surface of the box, which bridging is unsightly and potentially insecure.

SUMMARY OF THE INVENTION

The present invention provides a device for applying lengths of pressure sensitive adhesive coated tape from a supply length of tape to rectangular objects or boxes driven along a predetermined path past the device in which an application member provides a low uniform force for pressing tape against the leading surface of a box moving along the path so that the front wall will not be pushed in adjacent its edge even with application of tape to relatively flimsy boxes such as those made of chipboard.

In the device according to the present invention this is done by mounting the application member for movement along a generally linear path from a contact position at which it will be contacted by the leading surface of a box moving along the path to a second position at which it will be against the one side of the box as the box moves past the contact member, which linear path is disposed at an angle in the range of about 35 to 55 degrees (preferably 45 degrees) with respect to the predetermined path for the box so that one component of movement of the contact member from its contact to its second position is in the direction of movement of the box. With this arrangement the force applied by the leading suface of the box to move the application member to its second position is essentially uniform as the application member traverses the leading surface of the box, and can be adjusted via means biasing the application member to its contact position so that firm engagement of the tape against the entire front surface of the box will be provided without pushing in the front wall of the box adjacent its edge. Thus there will be no substantial bridging of tape between the front wall and the cover flaps of a taped box, and the tape extending between these box portions will reinforce the front wall of even a very flimsy box so that the tape can subsequently be firmly buffed against the box by conventional buffing members mounted on pivot arms.

Also the present invention includes a simplified means for positioning an end portion of the supply length of tape along the application member prior to contact therewith by a rectangular object or box. This means includes a guide member extending transverse of the tape path closely adjacent the application member, which guide member has a generally V-shaped groove in its periphery aligned with and generally centered along the path; and means for pressing the adjacent portion of a tape along the path into the groove which will form a longitudinally extending ridge in the portion of the tape extending adjacent the application member, thereby preventing the tape from curling away from the application member and insuring its proper position for contact by the box.

DESCRIPTION OF THE DRAWING

The present invention will be further described with reference to the accompanying drawings wherein like numerals refer to like parts throughout the several views and wherein:

FIGS. 4, 5, 6, 7 and 8 are enlarged fragmentary views sequentially illustrating the application of tape to a box by one of the devices incorporated in the machine shown in FIG. 1;

FIG. 9 is an enlarged fragmentary view of a portion of the device as illustrated in FIG. 8; and FIG. 10 is a view taken approximately along lines 10—10 of FIG. 9.

DESCRIPTION OF THE PREFERRED EMBODIMENT

Figure 2:
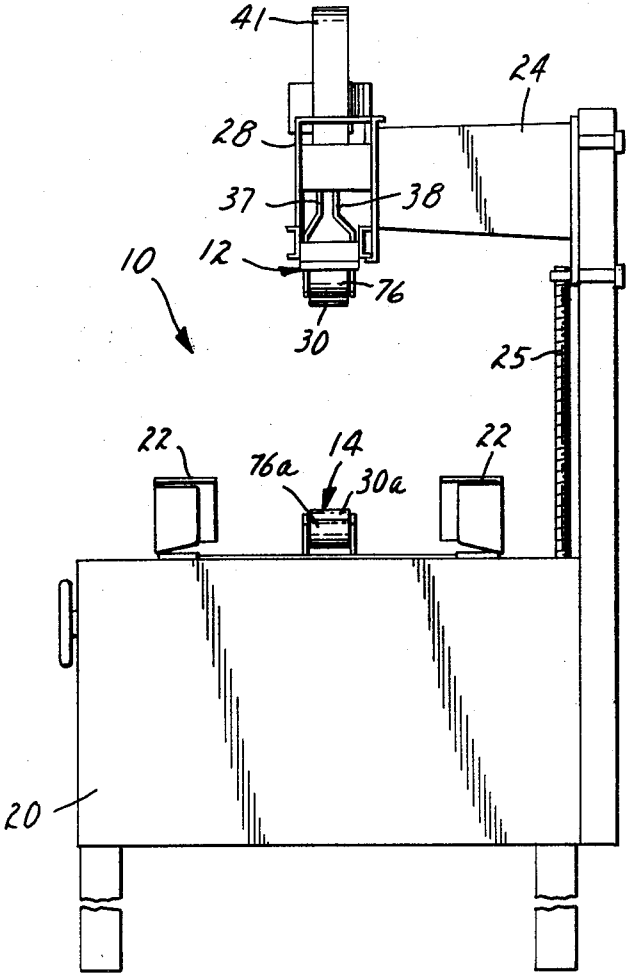
FIG. 2 is an end view of the machine shown in FIG. 1.

Referring now to the drawing, there is illustrated a machine 10 incorporating two tape-applying devices 12 and 14 according to the present invention disposed to apply lengths of pressure sensitive adhesive coated tape from supply lengths of tape 16 seriatim around the peripheries of spaced rectangular objects or boxes 18 driven along a predetermined path through the machine 10.

Figure 1:
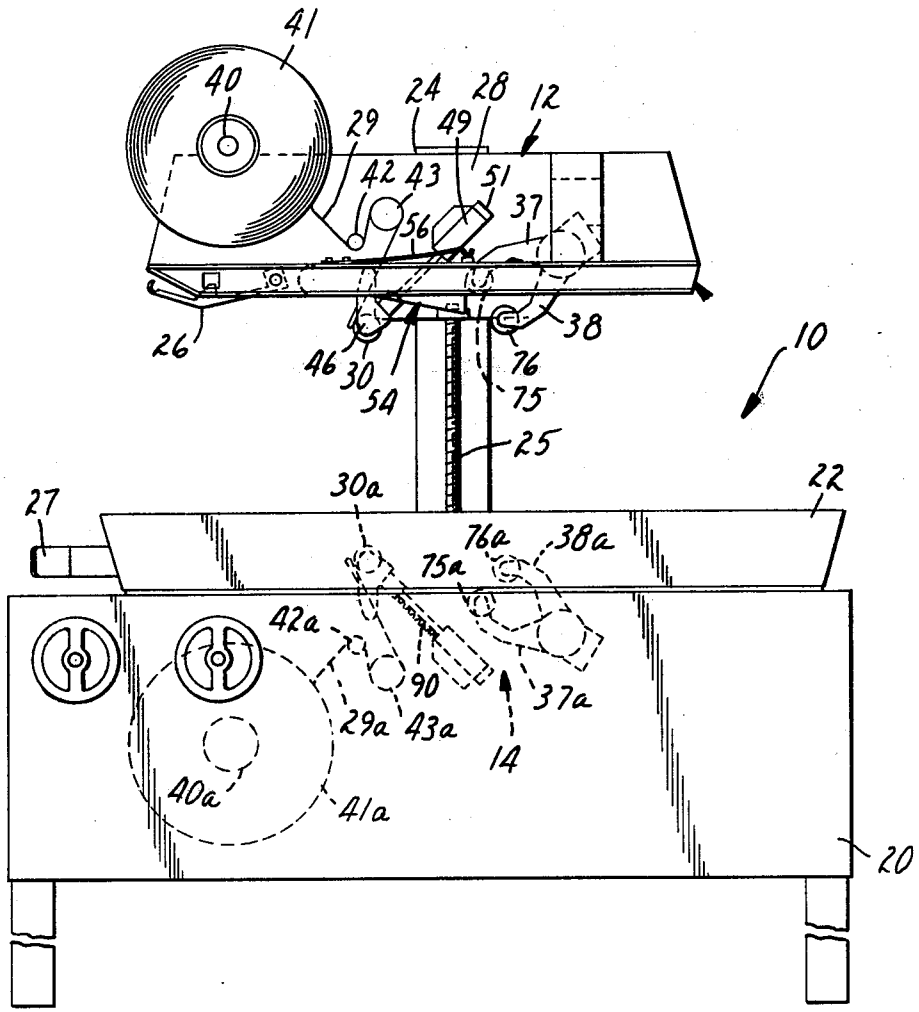
FIG. 1 is a side view of a machine incorporating two tape-applying devices according to the present invention.
Figure 3:
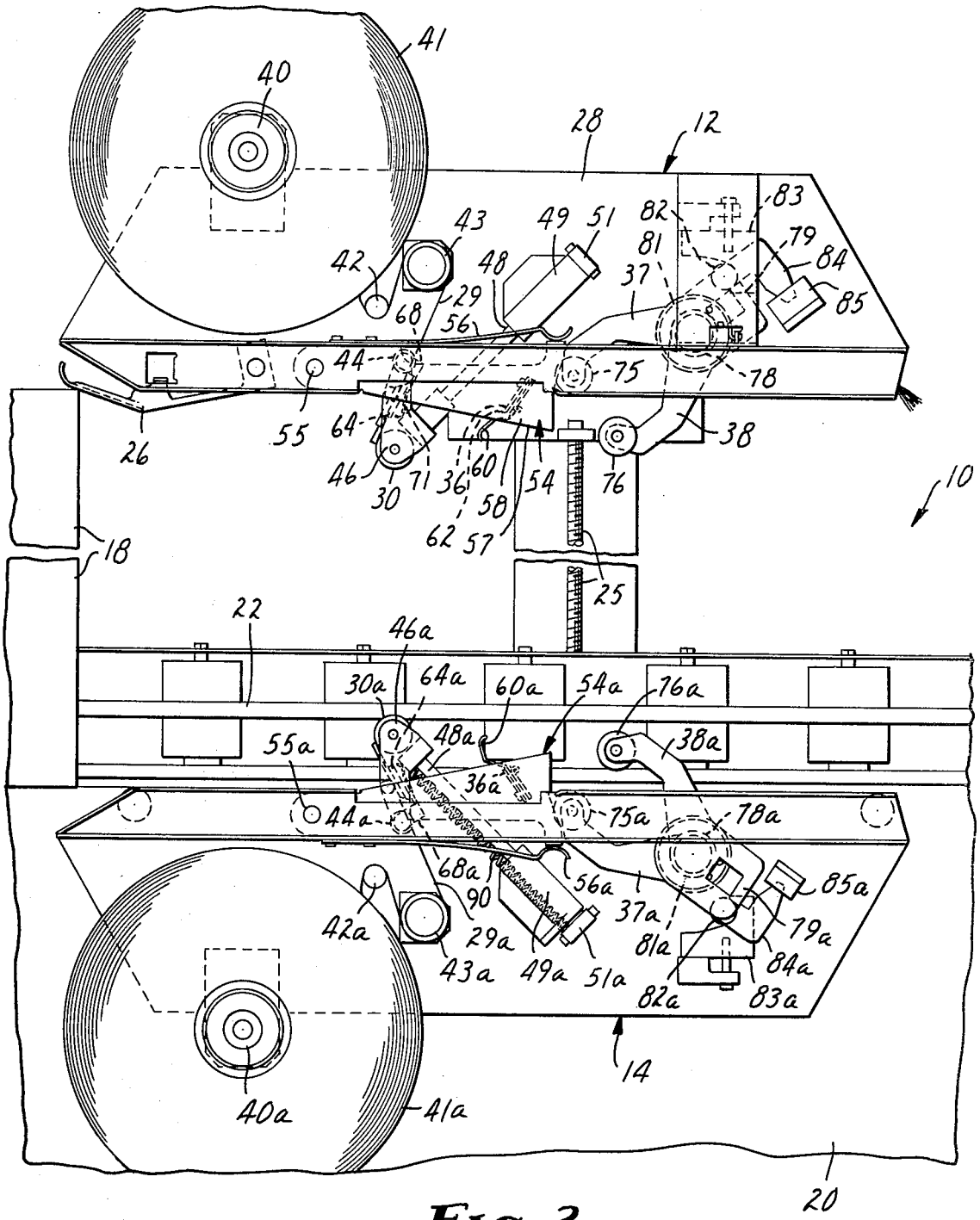
FIG. 3 is an enlarged fragmentary view of the two devices included in the machine shown in FIG. 1.

As is seen in FIGS. 1 and 2, the machine 10 comprises a base portion 20 supporting one of the tape-applying devices 14 and including spaced conveyors 22 adapted to grip the sides of a box placed along the path and to propel the box past the devices 12 and 14; and a vertically movable upper frame portion 24 on which is supported the other of the devices 12 and which is adapted to move vertically to bring the uppermost device 12 into contact with the uppermost portions of a box propelled through the machine 10.

The machine 10 includes means for moving the conveyors 22 toward each other from an initial spaced apart position to positions at which they will engage the side surfaces of boxes of different widths to propel the boxes along the path; and means for moving the upper frame portion 24 downwardly via rotation of a threaded shaft 25 from an initial raised position to positions (indicated via a microswitch by contact of an arm 26 pivotably mounted on the overhead frame portion 24 with the box) at which the device 12 mounted thereon will engage the upper surface of boxes of different heights; which means are both activated when the box is positioned on the path so as to depress the machine activating lever 27. Such means are not described in detail herein since they are well known in the art and provide no portion of the present invention.

Briefly, as is best seen in FIGS. 3 through 10, the device 12 includes a frame 28; means adapted for defining a tape route for a supply length of tape 29 along the frame 28 including an application member or roller 30; means for positively positioning an end portion of the supply length of tape 29 adjacent the application roller 30 with the adhesive coating on the tape disposed away from the application roller 30 on its side from which boxes approach the application roller 30, which means includes a support member 32 adjacent the application roller 30 having a groove 33 centered on the tape path and means for pushing an adjacent portion of the tape 28 into the groove 33, thereby forming a central ridge in the tape end portion to straighten it so that it will project from the support member 32 to a position adjacent the application roller 30; and means for mounting the application roller 30 on the frame 28 to afford movement thereof (1) from a contact position (FIGS. 3 and 4) in the path for boxes through the machine 10 to afford contact between the leading surface of a box driven along the path and the end portion of the supply length of tape 29 adjacent the application roller 30 to adhere the tape 29 to the box, (2) along a linear path disposed at about a 45 degree angle to the path of the box with a component of movement for the application roller 30 being in the direction of movement of the box along the path to afford movement of the application roller 30 along tape being pulled from the supply length 29 and extending transverse of the leading surface of the box and around its leading edge, (3) to a second position of the application roller 30 (FIGS. 5 and 6) where it will press tape against the side surface of the box, and (4) back to its contact position after the box has passed (FIG. 8). Means including a knife 36 are also provided for severing an applied length of tape from the supply length 29 (FIG. 7) after the box passes the application roller 30, as are means including two arms 37 and 38 for firmly buffing the applied length of tape to the surfaces of the box (FIGS. 5, 6, 7 and 8).

The means adapted for defining a tape route includes a hub 40 mounted for frictionally retarded rotation on the frame 28, about which hub 40 a supply roll 41 of the tape 29 may be releasably engaged; an idler roller 42 rotatably mounted on the frame 28; and the tension roller 43 having a knurled surface adapted for releasable contact with the adhesive surface of the tape, which tension roller 43 is rotatably mounted to the frame via an adjustable friction clutch (not shown) to provide a desired tension in the tape 29 along the path subsequent to the tension roller 43. Also included are a second knurled idler roller 44 for guiding the adhesive coated surface of the tape; the application roller 30; and the support member or ridging roller 32 which has the groove 33 and is disposed between the idler roller 44 and application roller 30, all of which rollers 30, 32 and 44 are rotatably mounted on a yoke 46.

The means for mounting the application roller 30 on the frame 28 for linear motion comprises the yoke 46 in which the application roller 30, ridging roller 32 and idler roller 44 are rotatably mounted, and a pair of parallel rods 48 fixed to and projecting from the yoke 46 at right angles to the axis of the application roller 30. The rods 48 are mounted in a pair of linear bearings 49 fixed to the frame 28 for axial sliding movement from the contact position of the application roller 30 in the path for boxes through the machine 10 (FIGS. 3 and 4) defined by abutment of a stop bar 51 fixed to the ends of the rods 48 opposite the yoke 46 with the adjacent ends of the bearings 49, and the second position for the application roller 30 (FIGS. 5 and 6) along the side surface of a box moving along the path. Such axial movement of the rods 48 in the bearings 49 affords movement of the application roller 30 over tape being applied along the front surface of a box moving along the path, and then around the leading edge and along the side surface of the box (FIGS. 5, 6 and 7), and then back to its application position (FIG. 8) under the influence of biasing means provided only by the weight of the assembly including the application roller 30, yoke 46, and rods 48, after the knife 36 has severed the tape applied to a box from the supply tape 29.

The means for severing an applied length of tape from the supply length 29 after tape has been applied to a box moving along the path in the machine 10 comprises a shoe 54 mounted for pivotal motion around a pin 55 fixed to the frame 28 between a normal position to which the shoe 54 is biased by a leaf spring 56 between the shoe 54 and the frame 28 with an edge surface 57 of the shoe 54 projecting into the path for the box through the machine 10, and a set position with the edge surface 57 of the shoe 54 resting against the side of a box moving along the path. The shoe 54 has a generally U-shaped cross section opening toward the path for the box partially defined by parallel side walls 58 providing the edge surface 57 at their distal edges. The side walls 58 are spaced to receive the tape 29 therebetween, and the knife 36 is fixed between the side walls 58 of the shoe 54. A knife guard 60 is pivotably mounted along a side surface of the knife opposite the pin 55 to afford movement of the guard 60 from a safety position adjacent a serrated edge 62 of the knife (to which safety position the guard 60 is biased by a spring at its pivot point) and a position spaced from the edge 62 of the knife 36 (FIGS. 5 and 6) upon contact of a distal portion of the guard sized to extend past the surface 57 of the shoe 54 to engage the surface of a box moving along the path. As is best seen in FIG. 7, the guard 60 also has sufficient length to extend beyond the distal end of the shoe 54 so that the guard 60 will remain in contact with a box moving along the path after the surface 57 of the shoe has lost contact therewith. As such contact is lost, the shoe 54 will return to its normal position under the influence of the leaf spring 56 while the guard 60 remains retracted from the edge 62 of the blade 36 via contact with the box so that the edge 62 of the blade 36 will engage and sever a length of tape 29 extending from the trailing surface of the box to the application roller 30 (FIG. 8). This will produce a length of tape extending from the trailing edge of the box which will be applied to the trailing surface of the box by the buffing arms 37 and 38, as will later be explained.

The means for positively positioning an end portion of the supply length of tape 29 along the application roller 30, best seen in FIGS. 9 and 10, comprises the ridging roller 32 which is rotatably mounted on the yoke 46, and a bar 64 having a ridge 65 adapted to press an adjacent portion of the tape 29 along the path into the groove 33 on the ridging roller 32 to form a longitudinally extending ridge in the end portion of the tape extending adjacent the application roller 30. The groove 33 extends around the periphery of the ridging roller 32 in a position centered axially of the ridging roller 32 and the path for the tape 29. The groove 33 is generally V-shaped, with the V-shaped contour of the groove 33 being defined by closely spaced edge surfaces on intersecting annular planar surfaces disposed parallel or at right angles to the axis of the ridging roller 32. These edge surfaces limit contact of the adhesive coating on the tape with the support roller 32 in the groove 33.

Means are provided for both pressing the bar 64 into the groove 33 to ridge the center of the end portion of the tape 29 projecting from the ridging roller 32 to a position adjacent the application roller 30 when the tape 29 is not being applied to a box, and for removing the bar 64 from the groove 33 in the ridging roller 32 when tape 29 from the device 12 is applying to a box moving along the path to restrict transverse gathering of the applied tape. The bar 64 is mounted on a bracket 68 pivotably mounted on one end about a shaft 69 supporting the knurled guide roller 44 for movement between a position within the groove 33 to which the bar 64 is biased by a spring 71 having one end fixed to the bracket 68 and the other end bearing against the yoke 46, and a position spaced from the groove 33. When tape is not being pulled through the device 12, the spring 71 and bar 64 will press the portion of the tape 29 adjacent the bar 64 into the groove 33 to longitudinally ridge the end portion of the tape. After the end portion of the tape 29 is engaged with the leading surface of a box by the application roller 30, however, tension in the tape 29 being pulled through the device 12 by movement of the box (produced by the tension roller 43) will lift the bar 64 out of the groove 33 against the bias of the spring 71, thereby allowing the tape 29 to be pulled around the ridging roller 32 without being longitudinally ridged so that the tape will be smoothly applied to the box.

The means for firmly buffing an applied length of tape against a box driven along the path is of a conventional known design including the first and second buffing arms 37 and 38 which respectively rotatably support buffing rollers 75 and 76 at one end. The end of the second arm 38 opposite the roller 76 is fixed on a shaft rotatably mounted on the frame 28, and the corresponding end of the first arm 37 is mounted for pivotal movement about that shaft. A first coil spring 78 is connected between the first and second arms 37 and 38 to bias the arms 37 and 38 relative to each other to a position with bosses 79 on the arms 37 and 38 in engagement with each other to space the buffing rollers 75 and 76 apart. A second coil spring 81 is coupled between the shaft 77 and the frame 28 to bias the first arm 37 toward a start position defined by contact between a projection 82 on the first arm 37 and a stop 83 on the frame 28.

Figure 4:
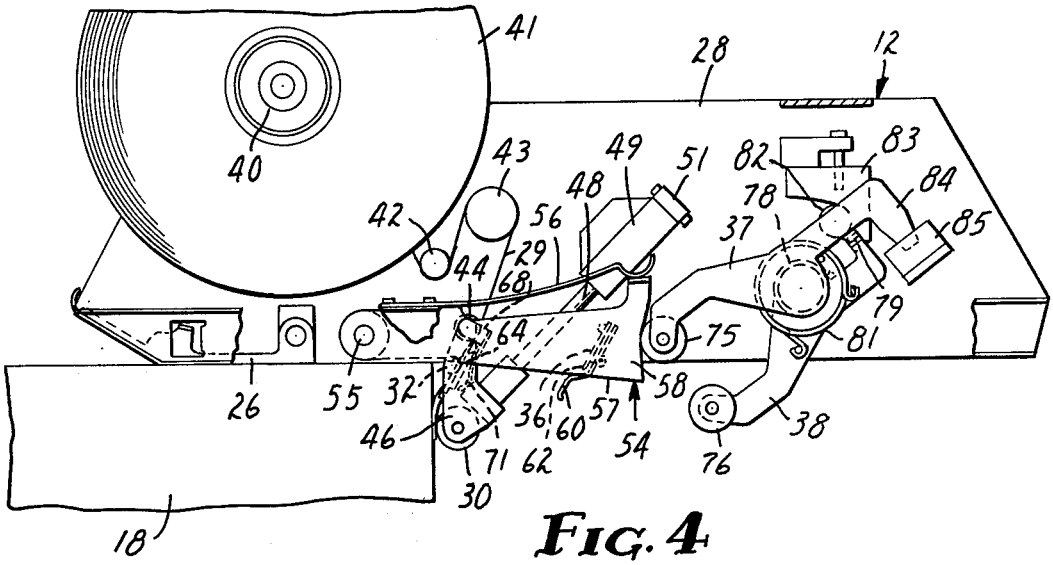

In their start positions the arcuate arms 37 and 38 position the buffing roller 75 on the first arm 37 in a position spaced from the path for a box moving past the device 12, and position the buffing roller 76 on the second arm 38 in the path for contact by the leading surface of a box driven past the device 12 (FIG. 4). After such contact (FIG. 5), the second arm 38 will rotate to move with the box while the second spring 81 presses its buffing roller 76 into contact with the tape applied on the leading surface of the box. Such rotation of the second arm 38 causes the first arm 37 to rotate under the influence of the first spring 78 until its buffing roller 75 forcefully contacts the tape applied along the side surface of the box. The buffing roller 75 on the first arm 37 will then sequentially move along that surface and the trailing surface of the box to press the applied tape into firm engagement therewith under the influence of the first spring 78, while the buffing roller 76 on the second arm 38 moves sequentially along the leading surface and along the side surface of the box to press the applied tape against those surfaces. When the buffing roller 76 on the second arm 38 loses contact with the box, the second coil spring 81 returns both arcuate arms 37 and 38 to their start positions, whereupon an extension 84 on the first arm engages a rubber bumper 85 fixed to the frame 28 to cushion the arms 37 and 38 as their returning motion is stopped by engagement of the projection 82 with the stop 83.

The device 14 on the machine 10 functions in the same manner as the device 12 and has essentially the same parts which are identified with the same reference numerals used in the description of parts for the device 12 except for the addition of the suffix "a". The parts of the device 14, however, are disposed in mirror image positions with respect to corresponding parts of the device 12, and include a spring 90 which is not used in the device 12 because of its disposure. The spring 90 in the device 14 is disposed between the bearings 49*a* and the yoke 46*a* to provide means for bearing the application roller 30*a* to its contact position, which biasing means for the application roller 30 is provided by gravity in the device 12.

Figure 5:
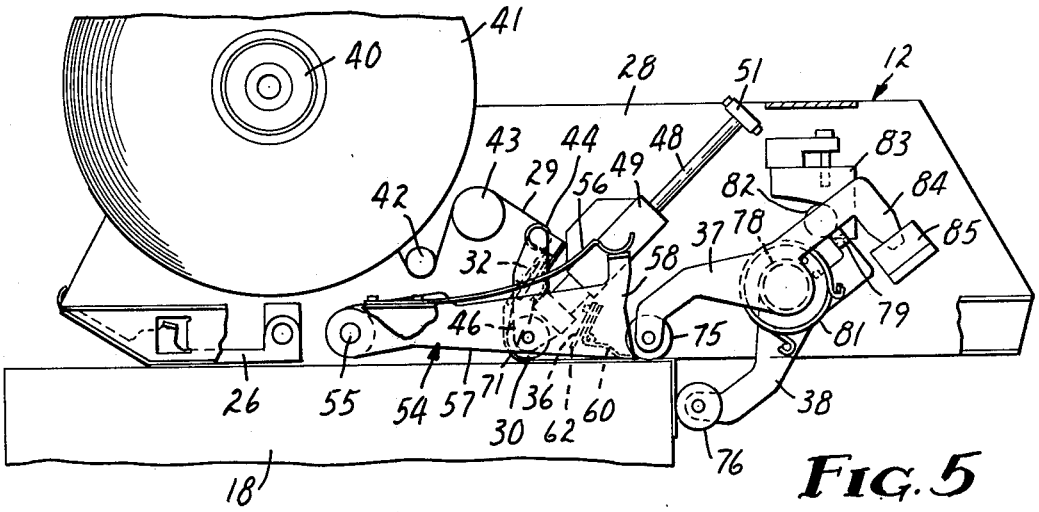
Figure 6:
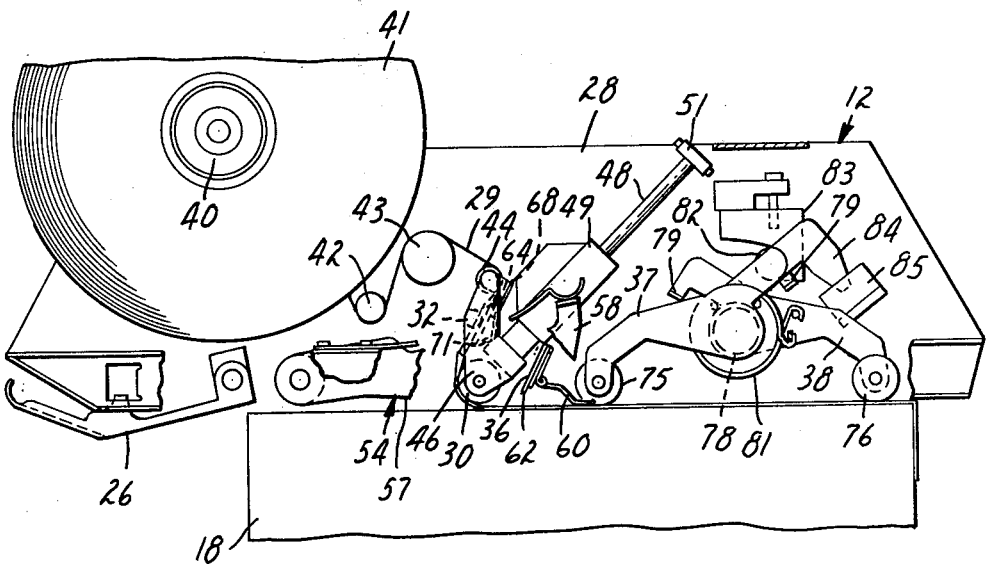

The operation of the device 12 in applying a length of tape will now be explained. Prior to movement of a box 18 past the device 12, the application roller 30 is in its contact position in the path for the box. An end portion of the supply length of tape 29 is positioned adjacent the application roller 30 with the adhesive surface on the tape facing the direction from which the box 18 will approach the device, and has a ridge formed along its center to keep it in proper position adjacent the application roller 30 via the bar 64 which presses a portion of the tape 29 into the groove 33 in the ridging roller 32 positioned adjacent the application roller 30. Upon contact with the leading surface of the box 18 driven along the path, the end portion of the tape 29 will adhere to the box 18. Subsequently, movement of the box 18 will first cause movement of the application roller 30 from its application position to its second position at the side surface of the box 18 against means (provided by gravity) for biasing the application roller 30 to its contact position which will press a portion of the tape 29 already positioned between the tension roller 43 and the box 18 into engagement with the box 18. After the application roller 30 reaches its second position, movement of the box 18 will pull tape from the roll 40 for application along the side surface of the box 18. Tension in the tape 29 being applied caused either by movement of the ridging roller 32 over the tape or by the friction clutch in the tension roller 43 as tape is pulled from the roll 40 will lift the bar 64 from the groove 33 against the bias of the spring 71 so that the tape 29 will be smoothly applied to the box 18. Movement of the application roller 30 from its contact to its second position is constrained to linear motion by the rods 48 and bearings 49 so that the force required from the leading surface of the box 18 to produce this movement is uniform as the application roller 30 travels transversely across the leading surface of the box 18. As the box 18 moves the contact roller 30 from its contact to its second position, it will also engage the edge surface 57 on the shoe 54 to move it to its set position, and contact the guard 60 for the knife 36 to pivot the guard 60 away from the knife's edge 62 (FIGS. 5 and 6). After the trailing edge of the box 18 subsequently moves past the application roller 30 and the distal end of the shoe 54, the shoe 54 will return to its normal position causing the knife 36 (the guard for which is still pivoted away from its edge by contact with the box 18) to sever the tape then extending between the application roller 30 and box (FIG. 7). Subsequently, with the tension in the supply tape 29 relieved, the bar 64 will again enter the groove 33 to cause a central ridge in the new end portion of the tape adjacent the application roller 30, and the application roller 30 will return to its contact position in preparation for another box. During such movement the application roller 30, ridging roller 32 and idler roller 44 on the yoke 46 will advance along the end portion until the application roller 30 is adjacent its distal end. During such advancement the annular edge surfaces defining the groove 33 provide even contact with the adhesive surface of the tape 29 on both sides of the groove to help keep it centered on the application roller 30 and ridging roller 32.

Movement of the box along the path will also cause it to engage the two buffing arms 37 and 38 which will buff the applied tape firmly against the surface of the box 18 in the manner described above.

I claim:

1. In a device adapted for applying lengths of pressure sensitive adhesive coated tape from a supply length of tape seriatim on the peripheries of spaced rectangular objects driven along a predetermined path in a first direction past the device, said device comprising:

a frame;

an application member having an arcuate periphery;

means adapted for defining a tape route for a said supply length of tape to the arcuate periphery of said application member with the adhesive coating disposed away from said application member;

means for mounting said application member on said frame to afford movement thereof from a contact position with said arcuate tape route portion in said path to afford contact between a said length of tape disposed along said arcuate tape route portion and the leading surface of a said object driven along said path in said first direction to adhere the tape to the leading surface object, to a second position while pressing tape against the leading surface of the object, at which second position said application member will press the tape being applied against the side surface of the object, and back to said contact position;

means mounted on said frame and adapted to be activated by movement of a said object past a predetermined position along said path for severing an applied length of tape from said supply length; and means for positively positioning an end portion of said supply length of tape adjacent said application member when said application member is in said contact position and during movement of said application member from said second position back to said contact position, the improvement wherein:

said means for mounting said application member on said frame mounts said application member for generally linear motion relative to said frame between said contact position and said second position with a component of movement for the application member being in said first direction.

2. A device according to claim 1 wherein said means for positively positioning an end portion of said supply length of tape along said application member comprises:

a support member extending transverse of said tape path closely adjacent said application member, said support member having a generally V-shaped groove in its periphery aligned with said path and generally centered along said path; and means for pressing the adjacent portion of a said tape into said groove to form a longitudinal extending ridge in the portion of the tape extending adjacent said application member.

3. A device according to claim 1 wherein said means for mounting said application member comprises a straight rod, and a bearing supporting said rod for axial movement to afford movement of said application member from said contact position to said second position.

4. A device according to claim 1 wherein said path is disposed at an angle in the range of about 35 to 55 degrees with respect to the predetermined path for the rectangular objects.

5. A device according to claim 2 wherein said device further includes means for separating said support member and said means for pressing when said device is applying tape to a said rectangular object to restrict transverse gathering of the applied tape.

6. A device according to claim 2 wherein said V-shaped groove is defined by spaced edge surfaces disposed in a generally V-shaped pattern.

7. A device according to claim 2 or claim 6 wherein said support member is cylindrical and said V-shaped groove extends around its periphery, and said means for positively positioning includes means for rotatably mounting said support member along said tape path.

* * * * *